US008122979B1

(12) United States Patent
Wright, Jr. et al.

(10) Patent No.: US 8,122,979 B1
(45) Date of Patent: Feb. 28, 2012

(54) OFFSET ROCK BIT WITH PULL BACK ADAPTER

(75) Inventors: Ronald F. Wright, Jr., Weatherford, TX (US); David G. Bullock, Weatherford, TX (US)

(73) Assignee: Radius HDD Direct, LLC, Perry, OK (US)

( * ) Notice: Subject to any disclaimer, the term of this patent is extended or adjusted under 35 U.S.C. 154(b) by 243 days.

(21) Appl. No.: 12/642,710

(22) Filed: Dec. 18, 2009

Related U.S. Application Data

(60) Provisional application No. 61/139,269, filed on Dec. 19, 2008.

(51) Int. Cl.
*E21B 10/62* (2006.01)

(52) U.S. Cl. ..... 175/398; 175/424

(58) Field of Classification Search ..... 175/62, 175/398, 414, 424; 405/154.1, 158, 159, 405/161, 164, 165, 168.1, 174, 175, 176, 405/177, 178, 180, 184.4
See application file for complete search history.

(56) References Cited

U.S. PATENT DOCUMENTS

| | | | | |
|---|---|---|---|---|
| 4,911,579 | A * | 3/1990 | Lutz et al. | 405/184 |
| 5,033,907 | A * | 7/1991 | O'Donnell et al. | 405/158 |
| 6,260,634 | B1 * | 7/2001 | Wentworth et al. | 175/61 |
| 7,976,243 | B2 * | 7/2011 | Rohde et al. | 405/184 |
| 2002/0112890 | A1 * | 8/2002 | Wentworth et al. | 175/57 |
| 2003/0106714 | A1 * | 6/2003 | Smith et al. | 175/6 |
| 2011/0250020 | A1 * | 10/2011 | Carter et al. | 405/184.3 |

* cited by examiner

*Primary Examiner* — Jennifer H Gay
*Assistant Examiner* — Blake Michener
(74) *Attorney, Agent, or Firm* — Tomlinson Rust Mckinstry Grable

(57) ABSTRACT

An offset rock bit (12) has a steering face (28) and a shoe (30) provided by a recess formed into the steering face (28). A slot (66) formed into the shoe (30) for receiving a pull back adapter (50) in a centrally located position in the forward end of the offset rock bit (12). The pull back adapter (50) has a pull back eye (52) with a central axis (62) which is aligned with a centrally disposed longitudinal axis (20) of the offset rock bit (12) and the tool string (10). This aligns the pull back eye (52) of the pull back adapter (50) with a borehole formed using the offset rock bit (12). The pull back adapter (50) also includes side edges (54, 56) which are configured for centering the pull back adapter (50) and pull back conduit within the borehole.

17 Claims, 2 Drawing Sheets

OFFSET ROCK BIT WITH PULL BACK ADAPTER

CROSS-REFERENCE TO RELATED APPLICATION

The present application is related to and claims priority to U.S. Provisional Patent Application Ser. No. 61/139,269, filed Dec. 19, 2008, entitled "Earth Boring Bit With Pull Back Coupling," and invented by Ronald (Riff) F. Wright, Jr.

TECHNICAL FIELD OF THE INVENTION

The present invention relates in general to earth boring bits, and in particular to offset rock bits for use in horizontal directional drilling for installing underground utilities.

BACKGROUND OF THE INVENTION

Horizontal Directional Drilling ("HDD") continues to grow as a construction alternative to open trenching for installation of conduit and pipelines for underground utilities. One discipline of the HDD industry is the delivery of fiber optic and high speed telecommunication transmission lines to homes and businesses, which is commonly called "Fiber to the Home" ("FTTH") or "Fiber to the Premises" ("FTTP"). With a majority of the primary fiber lines installed connecting major population areas across the United States, there is now a push to install optical fiber from local distribution hubs to each home. HDD is playing a large role in installing fiber to homes or businesses with as little disruption as possible to streets, sidewalks, driveways and landscapes. One aspect of this type of drilling is hole size. In most other HDD projects, an initial hole or "pilot hole" is made and a reamer or "hole opener" is pulled back and forth through the hole until an adequate size is achieved to allow passage of a selected size pipe or conduit. For FTTP projects the pilot hole is typically of adequate size for receiving one inch diameter conduit for passing a fiber line to an individual home or small premises. These bores are usually short and shallow and drilled with a small HDD rig, with FTTP boring contractors often making a number of these bores a day.

FTTP contractors who use rock bits to drill these short bores consider speed as being critical to profitability. Upon completing the pilot hole for an FTTP project, the end of a drilling tool string will exit the terminal end of the borehole and be pushed outward to expose a drill bit. The drill bit is then often removed and a separate device is secured to the end of the tool string to which a fiber conduit is connected for pulling back through the borehole with the tool string. Removal of the drill bit and installation of a pull back device is time consuming, and repeated removal and installation of the drill bit provides opportunity for damage to threaded connections and seals. Some HDD paddle bits have included a hole in the end of the paddle bits for attaching a shackle to connect pull back attachments for the conduit. Some offset rock bits have had a removable cutting tooth insert replaced by a tooth-like insert having an eye for attaching a shackle. However, these pull back attachment solutions result in securing pull back attachment devices to the drill string at points which are offset from a central longitudinal axis of the drill string, resulting in fiber conduit cutting into the wall of the borehole and becoming stuck during pull back.

SUMMARY OF THE INVENTION

An offset rock bit with a pull back adapter for use in horizontal directional drilling is disclosed. The offset rock bit is connected in a drill string having a longitudinal axis which is centrally disposed with the offset rock bit and the drill string. A cutting face provides a forward portion of the offset rock bit. A connection member is provided on a rearward portion of the offset rock bit for securing to other portions of the drill string. A heel extends from an intermediate portion of the offset rock bit. A steering face is defined to extend intermediate the cutting face and the heel at an acute angle to the longitudinal axis. The cutting face and the heel are spaced apart along the longitudinal axis, offset on opposite sides of the longitudinal axis. A shoe is provided by a recess formed into the steering face, with an enlarged forward portion located adjacent the cutting face and tapering to a narrow rearward portion located adjacent to the heel, with the shoe preferably being centrally disposed within the steering face. A slot is formed into the shoe, centrally disposed with the shoe and the steering face, and extending in a general direction of the longitudinal axis. A bolt hole is formed into the offset rock bit adjacent the heel and spaced apart from the steering face, and passes through the slot in a direction which is perpendicular to the longitudinal axis. A pull back adapter has a rearward portion for fitting within the slot, a first aperture extending through a first end thereof for aligning in registration with the bolt hole and adjacent the shoe, and a second aperture defining a pull back eye disposed on an opposite end of the pull back adapter from the first aperture. The pull back eye is adapted for receiving a shackle, such that when the pull back adapter is fully inserted into the slot the first aperture is disposed in registration with the bolt hole and the second aperture defining the pull back eye is disposed along the longitudinal axis.

DESCRIPTION OF THE DRAWINGS

For a more complete understanding of the present invention and the advantages thereof, reference is now made to the following description taken in conjunction with the accompanying drawings in which

FIG. 1 is a partial, side elevation view of a tool string for HDD drilling;

FIG. 2 is a partial longitudinal section view of a forward portion of the tool string, showing the offset rock bit and the pull back adapter being inserted into the offset rock bit;

FIG. 3 is a side elevation view of the offset rock bit with the pull back adapter installed into the offset rock bit; and FIG. 4 is a sectional view of the offset rock bit and pull back adapter, taken along section line 4-4 of FIG. 3.

DETAILED DESCRIPTION OF THE INVENTION

Figure 1:
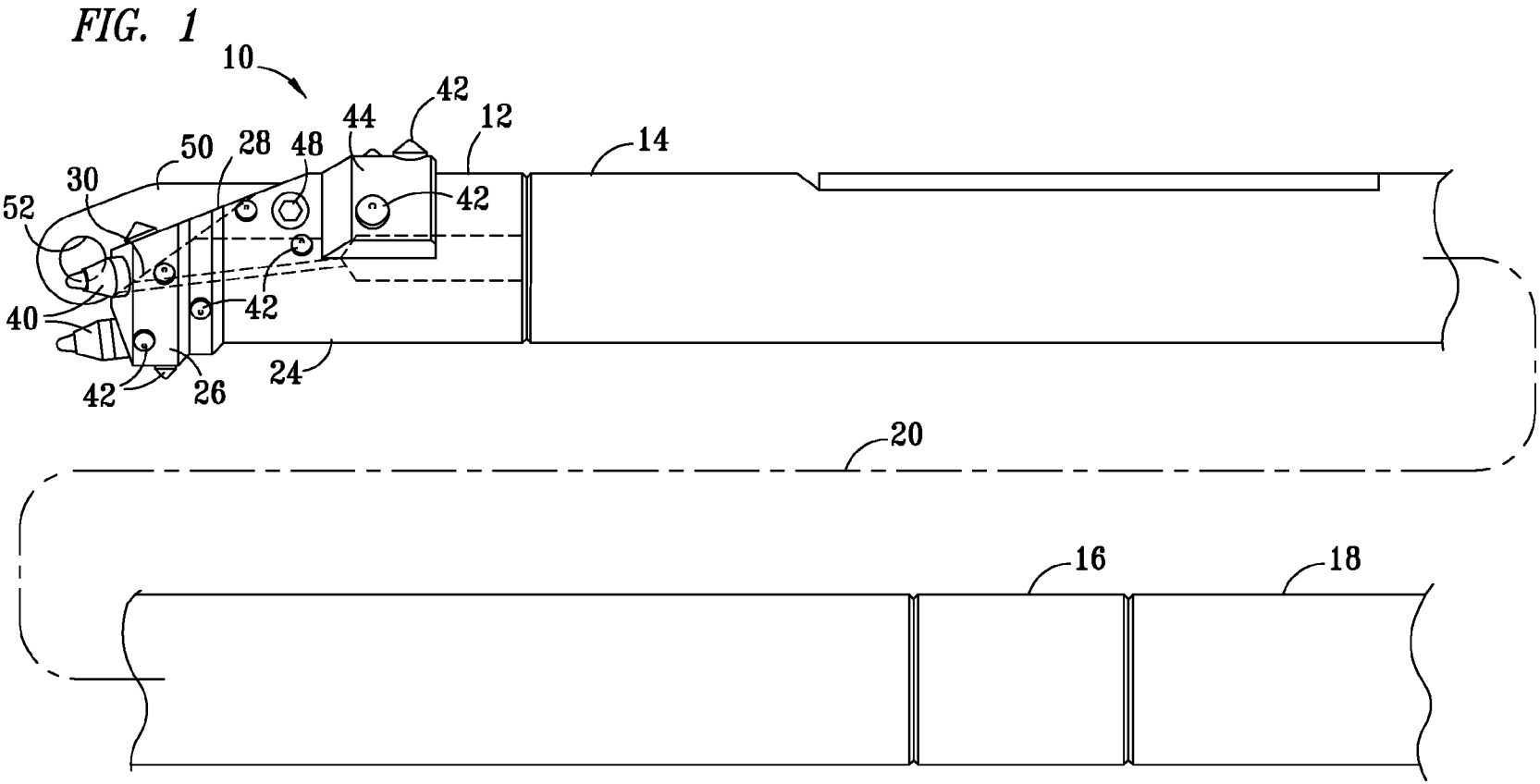
FIGS. 1 through 4 show various aspects for an offset rock bit with a pull back adapter for HDD drilling made according to the present invention, as set forth below.

FIG. 1 is a partial, side elevation view of a tool string 10 having a offset rock bit 12 with a sonde housing 14, an adapter 16 and a drill string 18. The tool string 10 has a longitudinal axis 20 which is centrally disposed for extending coaxially with a centerline of cross-sections of the threaded end 22 of the offset rock bit 12, the sonde housing 14, the adapter 16 and the drill string 18. The offset rock bit 12 has an exterior periphery 24 which provides a cutting face 26 and a heel 44 which are each offset from the longitudinal axis 20. Preferably, the cutting face 26 and the heel 44 are disposed on opposite sides of the longitudinal axis 20, spaced apart along the longitudinal axis 20 by a steering face 28. As shown in FIG. 1, the steering face 28 is preferably an upward facing, sloped end of the offset rock bit 12 which extends at an acute angle to the longitudinal axis 20. The steering face 28 extends from adjacent the cutting face 26 to adjacent the heel 44.

Figure 2:
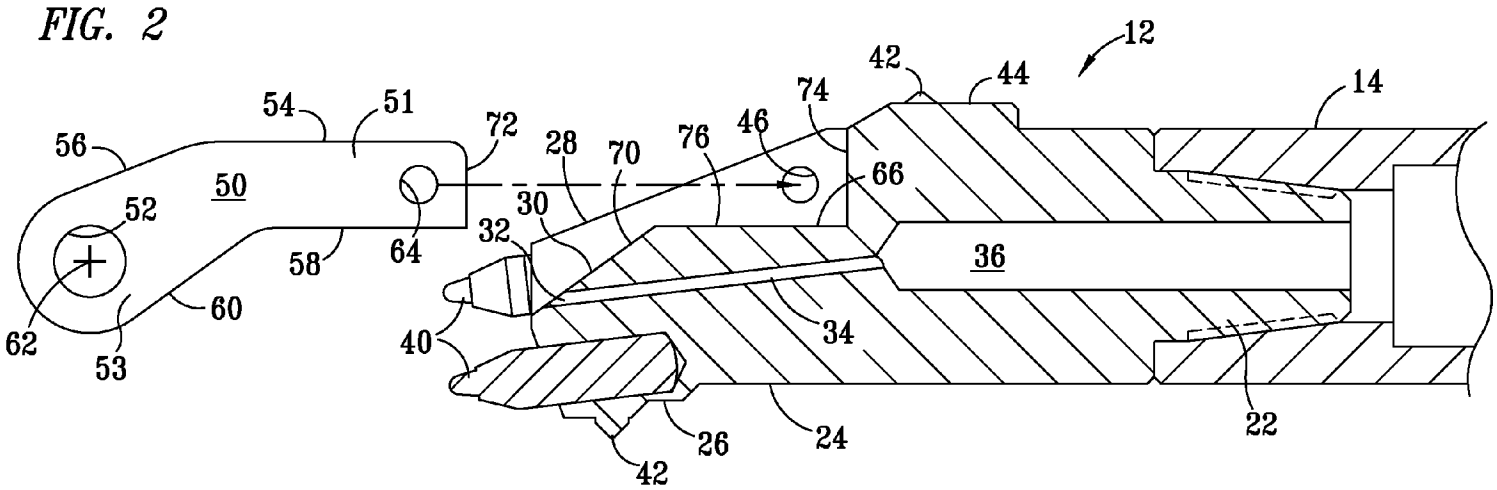
Figure 3:
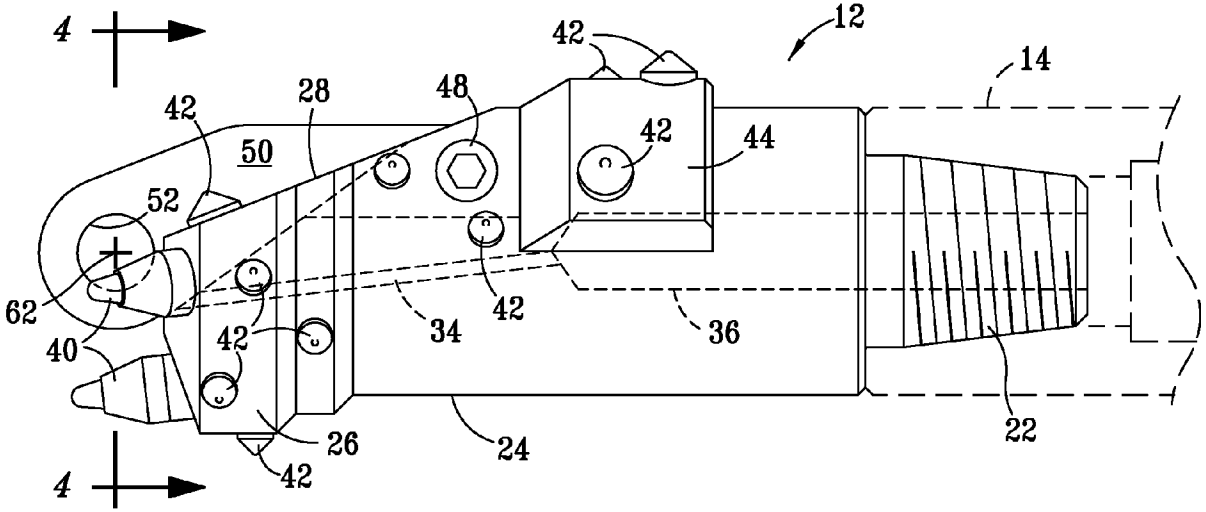
Figure 4:
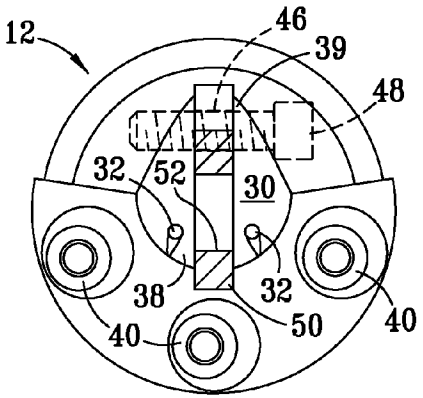

FIG. 2 is a longitudinal section view showing a pull back adapter 50 being inserted into the offset rock bit 12. FIG. 3 is a side elevation view of the offset rock bit 12 after the pull back adapter 50 has been installed. FIG. 4 is an end view of the offset rock bit 12, taken along section line 4-4 of FIG. 3. A shoe 30 is provided by a recess formed into a central portion the steering face 28 in the forward end of the offset rock bit 12. The shoe 30 has an enlarged portion 38 located on a forward end of the shoe 30 and adjacent to the cutting face 26. The steering face 28 preferably extends at a twenty to twenty-five degree angle to the longitudinal axis 20, or approximately twenty-two degrees. The shoe 30 preferably extends at a thirty to forty degree angle to the longitudinal axis 20, or approximately thirty-seven degrees. The shoe 30 tapers from the enlarged portion 38 to a narrow portion 39 disposed adjacent the heel 44. The narrow portion 39 is disposed on an opposite side of the longitudinal axis 20 from the enlarged portion 38, spaced apart along the longitudinal axis 20. Fluid flow ports 32 are located on the forward end of the bit 12 in the enlarged portion 38 of the forward end of the shoe 30. The fluid flow ports 32 provide exit apertures from respective ones of two side channels 34. The two side flow channels 34 connect to a main flow channel 36 which is in fluid communication with flow channels in the sonde housing 14 and the drill string 18. The flow channels provide fluids for lubricating the drill bit 12 and removing cuttings from the borehole. Teeth inserts 40 are provided for extending into apertures formed in the forward end of the offset rock bit 12. Raised carbide protrusions 42 are formed around the exterior periphery 24 of the offset rock bit 12. Two bolt holes 46 extend through the offset rock bit 12, aligned in registration for receiving a bolt 48. The two bolt holes 46 formed to extend into the offset rock bit 12 in a direction which is spaced apart from and perpendicular to the longitudinal axis 20. The bolt holes 46 extend parallel to spaced apart from the steering face 28, adjacent to the heel 44 and passing through a slot 66. Preferably, at least one of the bolt holes 46 are threaded for threadingly securing a bolt 48 thereto.

A slot 66 extends into the steering face 30 of the offset rock bit 12 for receiving the pull back adapter 50. The slot 66 preferably has a rearward end 74 which is perpendicular to the longitudinal axis 20 and an inward side 76 which is parallel to the longitudinal axis 20. The inward side 76 of the slot 66 is spaced apart from and disposed outward of the longitudinal axis 20. An outward side and a forward end of the slot 66 are open for receiving the pull back adapter 50 into the installed position shown in FIGS. 3 and 4.

A pull back adapter 50 is formed from a flat piece of steel having a rearward portion 51 for fitting in the slot 66, and a forward portion 53 which extends at an angle to the forward portion for aligning with the longitudinal axis 20. Wherein a centerline of said forward portion 53 extends at an angle of approximately one hundred and fifty degrees to a centerline of said rearward portion 51 and said longitudinal axis 20. A first aperture 64 extends into the rearward portion for aligning in registration with the bolt hole 46 for passing a bolt 48 to secure the pull back adapter into the forward end of the offset drill bit 12 when the pull back adapter 50 is fully inserted into the slot 66. A second aperture extends into the forward portion to define a pull back eye 52, which is adapted for receiving a shackle to connect a conduit for pulling back a conduit through a borehole formed using the offset drill bit 12. The pull back adapter 50 has an outer edge 54 defining a surface which, when the pull back adapter 50 is fully inserted into the slot 66, is located directly adjacent to the side of the periphery 24 of the offset rock bit 12. The pull back adapter 50 also has a sloped forward surface 56 to prevent the pull back adapter 50 from hanging up on the borehole when being pulled back through the borehole for retrieval of the tool string 10. An edge 58 extends opposite the outer edge 54 of the pull adapter 50 to an inwardly sloped surface 60. Pull back eye 52 has a centerline 62 which, when the pull back adapter 50 is fully inserted into the slot 66, preferably intersects the longitudinal axis 20 with the centerline 62 perpendicular to the longitudinal axis 20.

When the pull back adapter 50 is fully inserted within the slot 66, preferably the edge 58 is located adjacent to and flush with the inward side 76 of the slot 66 and the sloped surface 60 is located adjacent to and flush with the sloped surface 70 of the shoe 30. A rearward end 72 of the pull back adapter 50 is provided for butting up against and engaging an edge 74 of the slot 66. With the pull back adapter 12 installed and the bolt 48 secured through holes 46 and 64, the rear side 72 of the pull-back adapter 12, the bottom side 58 of the pull-back adapter 12, and the sloped surface 60 are positioned flush against the end 74 and inward side 76 of the slot 66, and the sloped surface 70 of the shoe 30 such that the pull back adapter 12 will not pivot on the bolt and the centerline 62 of the pull back eye 62 will remain in longitudinal alignment with the longitudinal axis 20 to remain in the "centered" position. That is, if a pullback line secured to the pull back adapter 50 becomes "slack" with the heel 44 of the offset rock bit 12 resting on the bottom of a borehole and the cutting face 26 at the 12 o'clock position in the borehole, the pull-back adapter 12 will not pivot on the bolt 48 and will remain in a centered position with the pull back eye 52 aligned with the longitudinal axis 20.

In operation, the tool string 10 with the offset rock bit 12 is used in normal fashion for horizontal direction drilling, such as for installing fiber to a premises. Once a borehole is drilled, the offset rock bit 12 is pushed out of the hole to expose the bolt 48 and the shoe 30. The bolt 48 is removed from the hole 46, and the slot 66 is cleaned to allow insertion of the pull back adapter 50. Then, the pull back adapter 50 is fully inserted into the slot 66 until the first aperture 64 aligns in registration with the bolt holes 46. The bolt hole 48 is inserted through the bolt holes 46 and the first aperture 64, and threadingly secured to at least one of the bolt holes 48 and the first aperture 64 to secure the pull back adapter 50 into the forward end of the offset rock bit 12. Then, the eye 52 of the pull back adapter 50 is used to secure a shackle for pulling back conduit, tubing, fiber conductors, or the like, through the borehole when the tool string 10 is retrieved with the offset rock bit 12. Preferably, the center line 62 of the pull back eye 52 is aligned with and perpendicular to the longitudinal axis 20 of the tool string 10 to center the pull back eye 52 in a central region of the earthen borehole and thereby prevent the conduit, or the like, being pulled back from pressing into a sidewall of the borehole and becoming hung. Centering the pull back eye 52 and the pull back conduit also reduces the forces required to be overcome to pull the drill string 10 and the attached conduit back through the borehole.

The present invention provides advantages of an offset rock bit with a pull back eye centrally located aligned with a centrally disposed longitudinal axis of the bit and a borehole in which the bit is used. The offset rock bit is first used without the pull back eye. When the offset rock bit is at the terminal end of the borehole at a ground surface, the pull back eye is inserted into and bolted to the bit for attaching conduit for pulling back through the borehole with the offset rock bit and the drill string. Locating the pull back eye concentric with a centrally disposed longitudinal axis of the drill string and the bit aids in preventing the conduit from hanging up on the borehole wall during pull back.

Although the preferred embodiment has been described in detail, it should be understood that various changes, substitutions and alterations can be made therein without departing from the spirit and scope of the invention as defined by the appended claims.

What is claimed is:

1. In an offset rock bit for use in a drill string for horizontal directional drilling, the drill string having a longitudinal axis which is centrally disposed with said offset rock bit and the drill string, and said offset rock bit having an exterior periphery with a forward portion providing a cutting face, a rearward portion providing a connection member, an intermediate portion providing a heel and a steering face, with said steering face extending intermediate said cutting face and said heel at an acute angle to the longitudinal axis, wherein said cutting face and said heel are spaced apart along the longitudinal axis, offset on opposite sides of the longitudinal axis, the improvement comprising:

a slot formed into said steering face, centrally disposed with said steering face and extending in a general direction of said longitudinal axis; and a pull back adapter having a rearward portion for fitting within said slot, a first aperture in a first end thereof, and a second aperture defining a pull back eye disposed on an opposite end of said pull back adapter from said first aperture and adapted for receiving a shackle, wherein said pull back adapter is configured such that said second aperture defining said pull back eye is disposed along said longitudinal axis when said pull back adapter is fully fitted within said slot.

2. The offset rock bit according to claim 1, further comprising a bolt hole formed into said offset rock bit perpendicular to the longitudinal axis, said bolt hole extending parallel to and spaced apart from said steering face, passing through said slot and disposed adjacent said heel, and wherein said first aperture is aligned in registration with said bolt hole and adjacent said steering face when said pull back adapter is fitted within said slot.

3. The offset rock bit according to claim 1, further comprising a shoe defined by a recess formed into said steering face, with said shoe being centrally disposed within said steering face, said slot being centrally disposed within said shoe.

4. The offset rock bit according to claim 3, further comprising said shoe having an enlarged forward portion disposed adjacent said cutting face and tapering to a narrow rearward portion disposed adjacent said heel.

5. The offset rock bit according to claim 1, wherein said pull back adapter is formed of a flat strip of metal, with said rearward portion having a longitudinal axis which is offset from a centerline of said second aperture.

6. The offset rock bit according to claim 1, wherein said slot is disposed to one side of said longitudinal axis.

7. The offset rock bit according to claim 6, wherein said slot extends adjacent to said heel.

8. An offset rock bit for use in a drill string for horizontal directional drilling, the drill string having a longitudinal axis which is centrally disposed with offset rock bit and the drill string, the offset rock bit comprising:

an exterior periphery having a forward portion providing a cutting face, a rearward portion providing a connection member, an intermediate portion providing a heel and a steering face, with said steering face extending intermediate said cutting face and said heel at an acute angle to the longitudinal axis, wherein said cutting face and said heel are spaced apart along the longitudinal axis, offset on opposite sides of the longitudinal axis;

a slot formed into said steering face, centrally disposed with said steering face and extending in a general direction of said longitudinal axis;

a bolt hole formed into said offset rock bit perpendicular to the longitudinal axis, said bolt hole extending parallel to and spaced apart from said steering face, passing through said slot and disposed adjacent said heel; and a pull back adapter having a forward portion and rearward portion, said rearward portion fitting within said slot such that said pull back adapter does not rotate relative to said slot, said rearward portion having a first aperture which aligns in registration with said bolt hole and adjacent said steering face when said rearward portion of said pull back adapter is fitted within said slot, and said forward portion having a second aperture defining a pull back eye disposed an opposite end of said pull back adapter from said first aperture and adapted for receiving a shackle, wherein said pull back adapter is configured such that said second aperture defining said pull back eye is disposed along said longitudinal axis when said rearward portion of said pull back adapter is fully fitted within said slot and said first aperture is disposed in registration with said bolt hole.

9. The offset rock bit according to claim 8, further comprising a shoe defined by a recess formed into said steering face, with said shoe being centrally disposed within said steering face, said slot being centrally disposed within said shoe.

10. The offset rock bit according to claim 9, further comprising said shoe having an enlarged forward portion disposed adjacent said cutting face and tapering to a narrow rearward portion disposed adjacent said heel.

11. The offset rock bit according to claim 10, wherein said pull back adapter is formed of a flat strip of metal, with said rearward portion having a longitudinal axis which is offset from a centerline of said second aperture, wherein said rearward portion of said pull back adapter fits flush against a rearward end of said slot and a inward side of said slot, and said forward portion of said pull back adapter fits flush against a surface of said shoe to non-rotatably fit said pull back adapter into said offset rock bit.

12. The offset rock bit according to claim 11, wherein said slot is disposed to one side of said longitudinal axis.

13. The offset rock bit according to claim 12, wherein said slot extends adjacent to said heel.

14. An offset rock bit for use in a drill string for horizontal directional drilling, the drill string having a longitudinal axis which is centrally disposed with offset rock bit and the drill string, the offset rock bit comprising:

an exterior periphery having a cutting face defining a forward portion of said offset rock bit, a connection member defining a rearward portion of said offset rock bit for securing to other portions of the drill string, a heel defining an intermediate portion of said offset rock bit, and a steering face defined to extend intermediate said cutting face and said heel at an acute angle to the longitudinal axis, wherein said cutting face and said heel are spaced apart along the longitudinal axis, offset on opposite sides of the longitudinal axis;

a shoe defined by a recess formed into said steering face, having an enlarged forward portion disposed adjacent said cutting face and tapering to a narrow rearward portion disposed adjacent said heel, with said shoe being centrally disposed within said steering face;

a slot formed into said shoe, centrally disposed with said shoe and said steering face, and extending in a general direction of said longitudinal axis;

a bolt hole formed into said offset rock bit perpendicular to the longitudinal axis, said bolt hole extending parallel to and spaced apart from said steering face, passing through said slot and disposed adjacent said heel; and a pull back adapter having a rearward portion for fitting within said slot such that said pull back adapter does not rotate relative to said slot and said offset rock bit, a first aperture in a first end thereof for aligning in registration with said bolt hole and adjacent said shoe when said pull back adapter is fitted within said slot, and a second aperture defining a pull back eye disposed on an opposite end of said pull back adapter from said first aperture and adapted for receiving a shackle, wherein said pull back adapter is configured such that said second aperture defining said pull back eye is disposed along said longitudinal axis when said pull back adapter is fully is fitted within said slot and said first aperture is disposed in registration with said bolt hole.

15. The offset rock bit according to claim 14, wherein said pull back adapter is formed of a flat strip of metal, with said rearward portion having a longitudinal axis which is offset from a centerline of said second aperture.

16. The offset rock bit according to claim 15, wherein said slot is disposed to one side of said longitudinal axis.

17. The offset rock bit according to claim 16, wherein said slot extends adjacent to said heel.

* * * * *